US006763899B1

(12) United States Patent
Ossia et al.

(10) Patent No.: US 6,763,899 B1
(45) Date of Patent: Jul. 20, 2004

(54) DEFORMABLE BLADES FOR DOWNHOLE APPLICATIONS IN A WELLBORE

(75) Inventors: Sepand Ossia, Houston, TX (US); Larry Bernard, Missouri City, TX (US); Alex G. Arzoumanidis, Houston, TX (US); Adame Kante, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 89 days.

(21) Appl. No.: 10/248,824

(22) Filed: Feb. 21, 2003

(51) Int. Cl.[7] ..... E21B 7/00

(52) U.S. Cl. ..... 175/57; 175/94; 175/100; 175/106; 415/903; 340/855.8; 367/911

(58) Field of Search ..... 175/57, 92, 94, 175/100, 106; 367/911; 415/903; 340/855.8

(56) References Cited

U.S. PATENT DOCUMENTS

| | | | | | |
|---|---|---|---|---|---|
| 3,021,910 | A | * | 2/1962 | Martin | 175/25 |
| 3,039,302 | A | * | 6/1962 | Willis | 73/152.34 |
| 3,614,260 | A | * | 10/1971 | Ellinger | 416/23 |
| 4,900,227 | A | * | 2/1990 | Trouplin | 416/132 B |
| 5,285,204 | A | * | 2/1994 | Sas-Jaworsky | 340/854.9 |
| 5,517,464 | A | * | 5/1996 | Lerner et al. | 367/84 |
| 6,015,263 | A | * | 1/2000 | Morris | 416/132 A |
| 6,527,513 | B1 | * | 3/2003 | Van Drentham-Susman et al. | 415/202 |

FOREIGN PATENT DOCUMENTS

| | | |
|---|---|---|
| WO | WO 02/068826 A2 | 9/1902 |
| WO | WO 93/09027 | 5/1993 |

* cited by examiner

*Primary Examiner*—Roger Schoeppel
(74) *Attorney, Agent, or Firm*—J.L. Jennie Salazar; Brigitte L. Jeffery; John Ryberg

(57) ABSTRACT

A method and apparatus for controlling fluidic torque in a downhole tool is provided. One or more rotatable components of the downhole tool comprise a deformable material, such as rubber or SMA, selectively deformable in response to the flow of fluid through the downhole tool. The rotatable components may include a rotor and/or a turbine of a generator in the downhole tool. Non-rotatable components, such as the stator of the generator, may also be deformable. The rotor, the stator, and/or turbine may comprise a deformable material capable of selectively deforming in response to the flow of drilling mud through the generator. The desired deformation and/or the desired torque may be controlled by adjusting the parameters of the components.

39 Claims, 5 Drawing Sheets

DEFORMABLE BLADES FOR DOWNHOLE APPLICATIONS IN A WELLBORE

BACKGROUND OF INVENTION

This invention relates to the flow of fluid through a downhole tool positioned in a wellbore. More particularly, this invention relates to controlling torque generated by fluids flowing through downhole tools during wellbore operations.

Downhole drilling operations, such as those performed in the drilling and/or production of hydrocarbons, typically employ drilling muds to cool the drill bit as the drilling tool advanced into the wellbore. As the drilling mud passes through the downhole tool, the flow of the mud may be used to operate turbines, sirens, modulators or other components in the downhole tool. These components are typically used in downhole operations, such as well logging, measurement while drilling (MWD), logging while drilling (LWD) and other downhole operations.

The flow of fluid through the downhole tool and across rotatable components in the downhole tool generates a torque. In an axial turbine, the torque is known to scale as the square of the flow rate. The torque generated by the fluid flow across rotor blades in downhole components, sometimes referred to as "fluidic torque," provides power and communication necessary to operate downhole components. Excessive torque at high flow rates increases the wear on the rotatable components resulting in higher failure rates of the downhole tool.

What is needed is a technique for adapting components to the flow of fluid through the downhole tool. It is desirable that such techniques optimize the operation of the downhole components in response to the flow of fluid thereby providing control of the torque generated. It is further desirable that such techniques achieve one or more of the following, among others: provide adjustable torque rates responsive to increased flow rates, provide durability in even severe drilling environments, utilize passive and/or adjustable controls, provide adjustability to various flow ranges, prevent high speed and/or high torque failures, provide a wider range of flow rates, allow for the passage of large particles and/or larger volumes of fluid, resist erosion and prevent mechanical failures.

SUMMARY OF INVENTION

In order to reduce the torque at high flow rates, deformable components of a generator in a downhole tool, such as a rotor, stator and/or a turbine blade, are provided. The components adapt to the flow of fluid by deforming in response to the flow of fluid as it passes. The physical parameters of the components, such as dimension, camber angle and/or shape, and/or the materials of the component may be adjusted to allow the component to deform as desired. By controlling the deformation of the component, the desired torque of the generator may also be controlled. The rotatable elements of other components may also incorporate rotatable blades to control torque therein.

In at least one aspect the invention relates to a pressure pulse generator for a downhole drilling tool. The drilling tool has a channel therein adapted to pass drilling mud therethrough. The tool includes a rotor rotationally mounted to a drive shaft in the generator, and a stator positioned in the pulse generator such that rotation of the rotor relative to the stator creates pressure pulses in the drilling mud. At least one of the rotor, the stator and combinations thereof is selectively deformable in response to the flow of drilling mud through the generator whereby the torque is controlled.

In another aspect, the invention relates to a method of controlling fluidic torque in response to the flow of fluid through a downhole drilling tool. The method includes providing the downhole drilling tool with a generator having a rotor and a stator, positioning the downhole drilling tool into a wellbore, passing fluid through the generator at an initial flow rate, increasing the flow rate of the fluid passing through the generator, and deforming one of the rotor, the stator and combinations thereof from an original position to a deformed position in response to the increased flow rate.

In yet another aspect, the invention relates to a downhole drilling tool having a channel therein adapted to pass drilling mud therethrough. The tool includes a modulator positioned in the downhole tool, and at least one blade operatively connected to the modulator. At least one blade is rotatable in response to the flow of fluid through the drilling tool. At least one blade is adapted to selectively deform in response to the flow of drilling mud through the channel.

Empirical and/or numerical analysis techniques may be used to optimize the blade configuration and to develop a computational model to determine the material constants for given torque specifications. A fluid-structure interaction model may be used for computational analysis of an MWD axial turbine and its deformable blades. This model, typically a three-dimensional model, may be used for design and optimization of such blades.

Other aspects of the invention will be appreciated from the following description.

DETAILED DESCRIPTION

Figure 1:
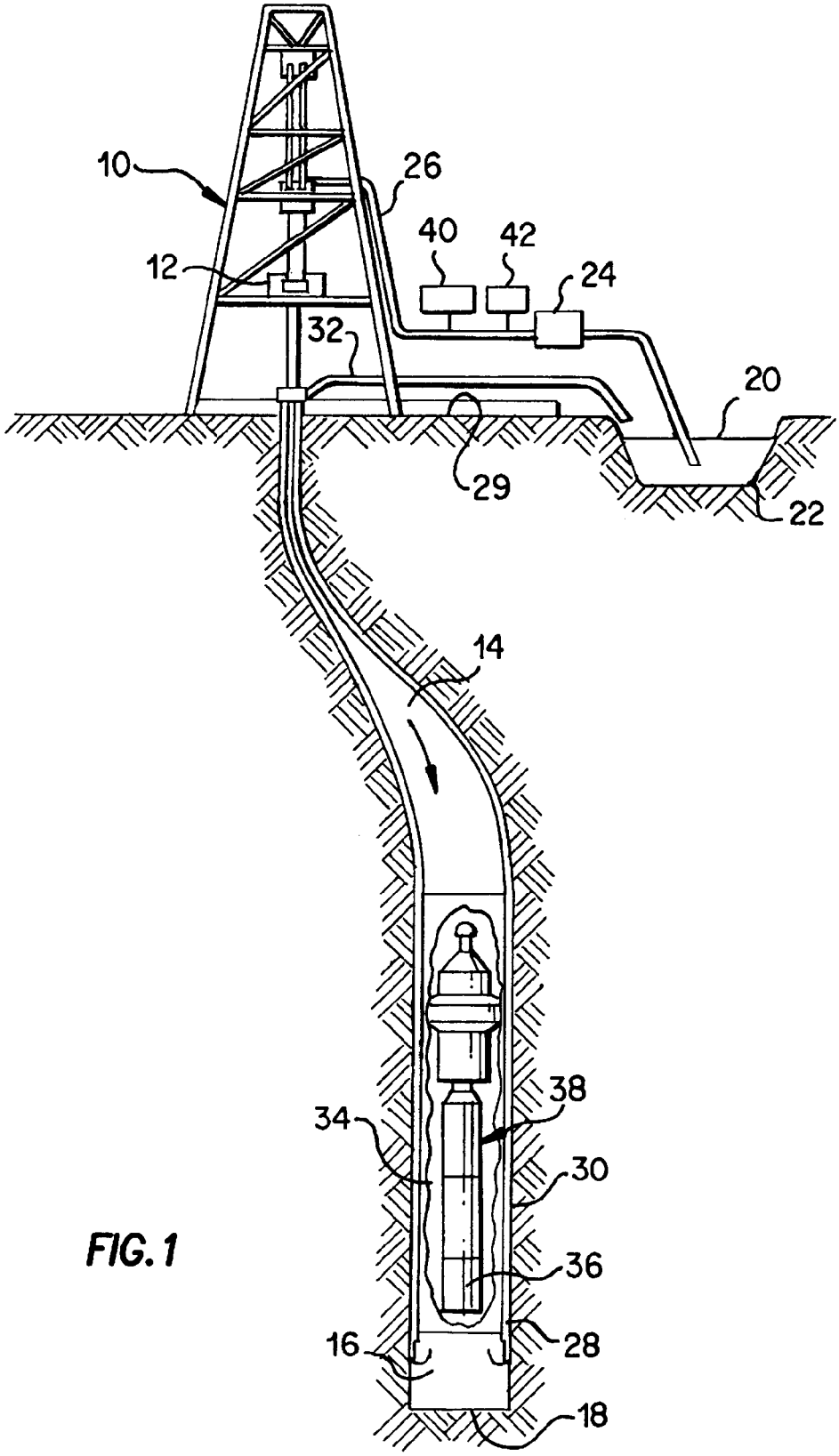
FIG. 1 is a schematic diagram of a downhole drilling tool in its typical drilling environment.

Referring now to FIG. 1, a drilling rig 10 is shown with a drive mechanism 12 which provides a driving torque to a drill string 14. The lower end of the drill string 14 carries a drill bit 16 for drilling a hole in an underground formation 18. Drilling mud 20 is picked up from a mud pit 22 by one or more mud pumps 24 which are typically of the piston reciprocating type. The mud 20 is circulated through a mud line 26 down through the drill string 14, through the drill bit 16, and back to the surface 29 via the annulus 28 between the drill string 14 and the wall of the well bore 30. Upon reaching the surface 29, the mud 20 is discharged through a line 32 back into the mud pit 22 where cuttings of rock and other well debris settle to the bottom before the mud is recirculated.

As is known in the art, a downhole drilling tool 34 can be incorporated in the drill string 14 near the bit 16 for the acquisition and transmission of downhole data. The drilling tool 34 includes an electronic sensor package 36 and a mud flow telemetry device 38. The mud flow telemetry device 38 selectively blocks passage of the mud 20 through the drill string 14 thereby causing changes in pressure in the mud line 26. In other words, the telemetry device 38 modulates the pressure in the mud 20 in order to transmit data from the sensor package 36 to the surface 29. Modulated changes in pressure are detected by a pressure transducer 40 and a pump piston position sensor 42 which are coupled to a processor (not shown). The processor interprets the modulated changes in pressure to reconstruct the data sent from the sensor package 36. It should be noted here that the modulation and demodulation of the pressure wave are described in detail in commonly assigned application Ser. No. 07/934, 137 which is incorporated herein by reference.

Figure 2:
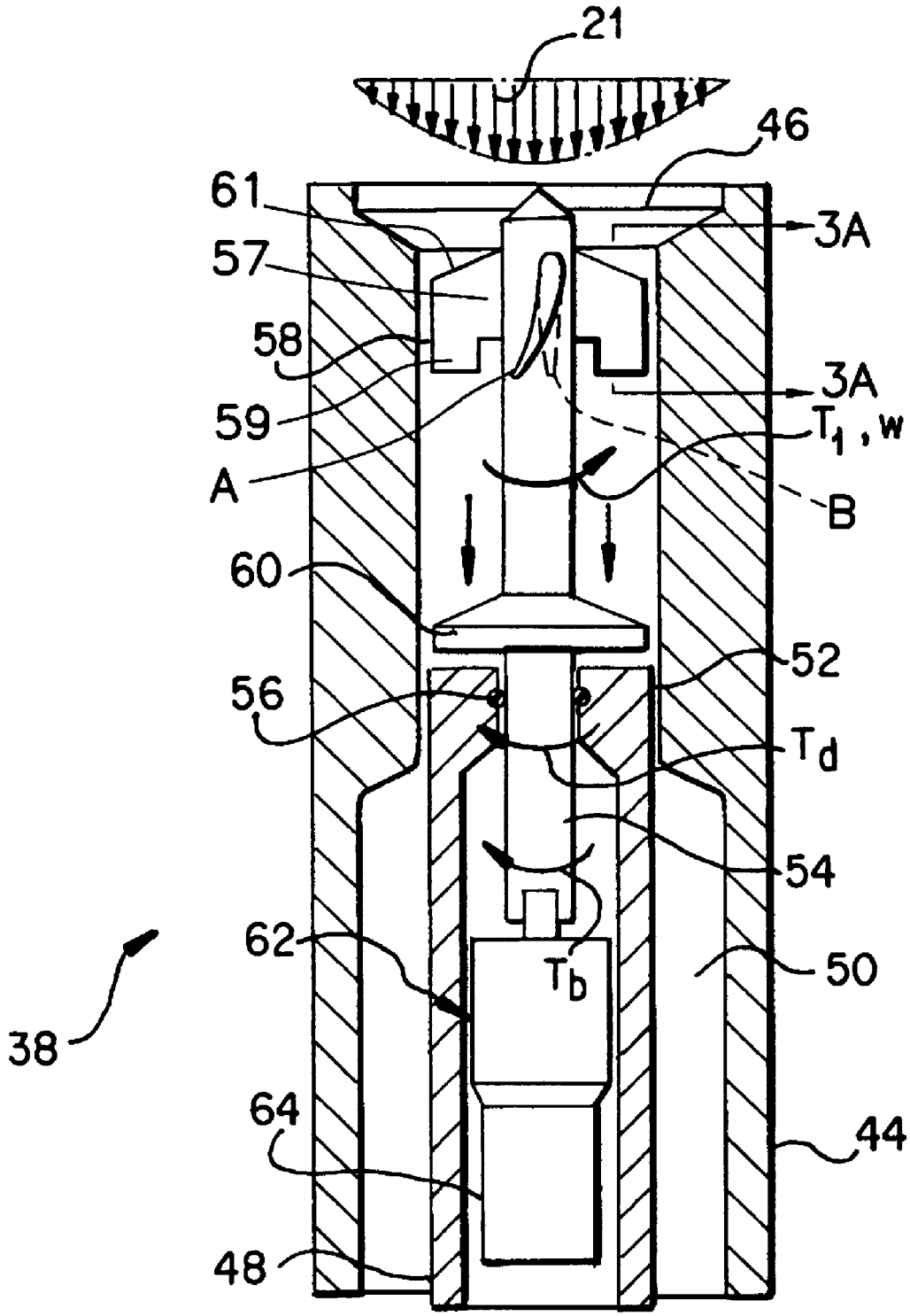
FIG. 2 is a conceptual schematic cross sectional view of the integrated modulator and turbine-generator.

Turning now to FIG. 2, the mud flow telemetry device 38 includes a sleeve 44 having an upper open end 46 into which the mud flows in a downward direction as indicated by the downward arrow velocity profile 21 in FIG. 2. A tool housing 48 is mounted within the flow sleeve 44 thereby creating an annular passage 50. The upper end of the tool housing 48 carries modulator stator blades 52. A drive shaft 54 is centrally mounted in the upper end of the tool housing by sealing bearings 56. The drive shaft 54 extends both upward out of the tool housing 48 and downward into the tool housing 48.

A turbine blade 61 is mounted at the upper end of the drive shaft 54 just downstream from the upper open end 46 of the sleeve 44. A modulator rotor 60 is mounted on the drive shaft 54 downstream of the turbine blade 61 and immediately upstream of the modulator stator blades 52. The lower end of the drive shaft 54 is coupled to a 14:1 gear train 62 which is mounted within the tool housing 48 and which in turn is coupled to an alternator 64. The alternator 64 is mounted in the tool housing 48 downstream of the gear train 62. The flow of fluid through the mud flow telemetry device 38 rotates the turbine and the rotor, and drives drive shaft 54 thereby creating a torque capable of creating power for the downhole tool. As fluid flow increases, the rotational speed and torque generate also increase.

The impeller 58 has a plurality of turbine blades 61, each blade having a first portion 57 and a second portion 59. The first portion 57 is attached to the drive shaft 54, and a second portion 59 extends therefrom. The turbine blade is depicted in FIG. 2 in an original/undeformed position A, and in a deformed position B. In the original position A, the blade 61 is curved. As fluid flows past the blade as indicated by the arrows, the fluid pressure force causes the blade 61 to deform, or bend, into the deformed position B. In position B, the blade has shifted from its original shape to a position where the blade curvature is less pronounced.

The term "blades" as used herein shall mean rotating blades, non-rotating blades and/or stationary portions of the downhole tool positioned adjacent to such rotating portions to control fluid flow, such as the rotor 60, stator 52, turbine blade 61 and/or stationary blades (not shown). While the blade 61 is originally depicted as curved, the blade may have a variety of geometries, angles, and/or positions. While the first portion is depicted as being secured, at least a portion of the first portion may be permitted to bend and/or deform. While the second portion is depicted as being detached, at least a portion of the second portion may remain undeformed. Additionally, various portions of the blade may be attached to the shaft and be designed to deform. For example, the all or part of the first and/or second portions may be secured to the shaft, and/or all or part of the first and/or second portions may be free to deform. The blade may deform to a variety of shapes depending on various factors, such as blade shape, flow characteristics and/or position of the blade along the tool.

Figure 3A:
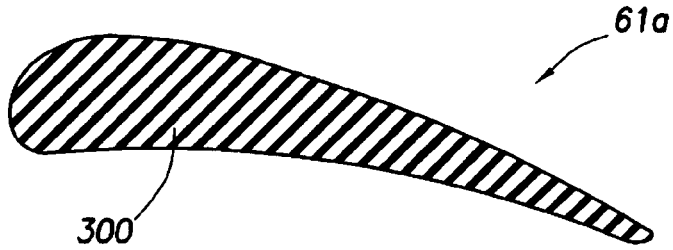
FIG. 3A is a cross sectional view the turbine blade of FIG. 2 taken along line 3A—3A.

Referring now to FIG. 3A, a cross sectional view of the blade 61 of FIG. 2 taken along line 3A—3A is depicted in greater detail. As depicted in FIG. 3A, the blade 61*a* is preferably an elongated body portion 300 made of a high deformable material, such as an elastomer (or rubber) capable of large strain deformation (for example, ASTM designations HNBR, FEPM, FKM or FFKM). The deformable material preferably deforms and/or bends in response to the force of fluid flow across the blade. The amount of deformation may be established by the strength and/or elastomeric properties of the deformable material.

Figure 3B:
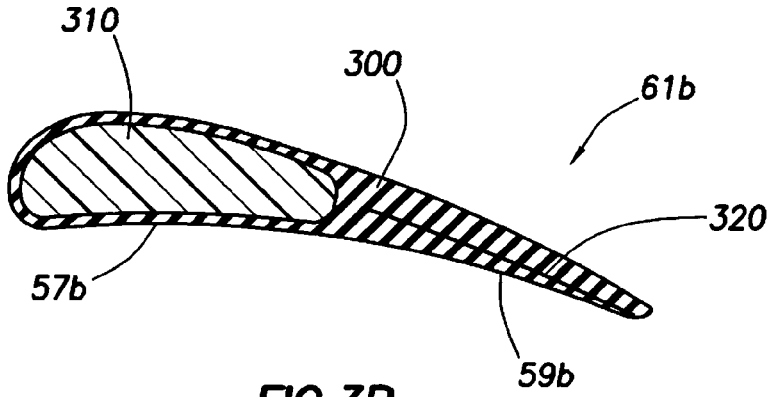
FIG. 3B is another embodiment of the blade depicted in FIG. 3A having a core and a spline.

FIG. 3B depicts the blade 61*b* of FIG. 3A with a core 310 and a spline 320 within body portion 300. The core is preferably a solid portion positioned within the first portion 57*b* of the blade 61*b*. The spline 320 is preferably elongate and is positioned within the second portion 59*b* of the blade.

The core 310 and the spline 320 are preferably made of a supportive material less deformable than the deformable material of the body 300, such as Stellite 6PM™, composites, various hardened elastomers, metals, etc. The core and/or support member provides additional rigidity to the rotor blade. While the core 310 and spline 320 may provide added rigidity and affect the flexibility of the body portion 300, the body portion 300 preferably remains deformable in response to fluid flow rates across the blade. The deformable material of the body portion 300 acts as a protective coating that wraps around the core 310 and the spline 320. The shape of the deformable material also determines the blade hydrodynamic characteristics under the action of the flowing fluid.

The size, shape and/or rigidity of the body portion, core and/or spline may be adjusted to provide the desired configuration. The core and/or spline are preferably positioned within the body portion to achieve the desired reduction of torque.

Figure 3C:
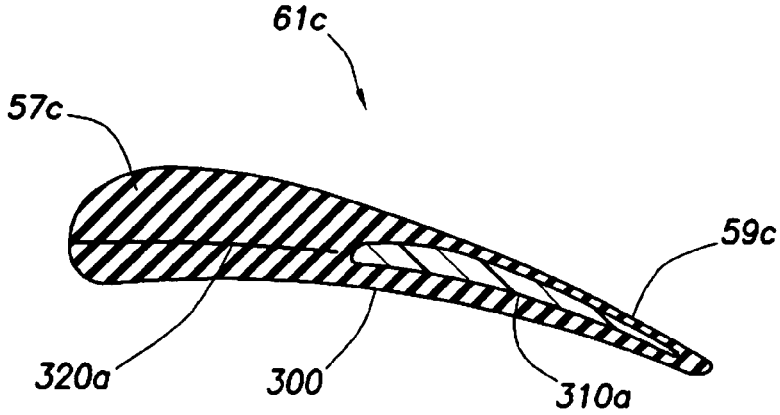
FIG. 3C is another embodiment of the blade depicted in FIG. 3A with the spline and core reversed.

FIG. 3C depicts another optional configuration for the blade 61*c*. This configuration is the same as the blade 61*b* of FIG. 3B, except that the blade 61*c* includes a spline 320*a* located in the leading-edge portion 57*c*, and a core 310*a* positioned in the second portion 59*c*.

Figure 3D:
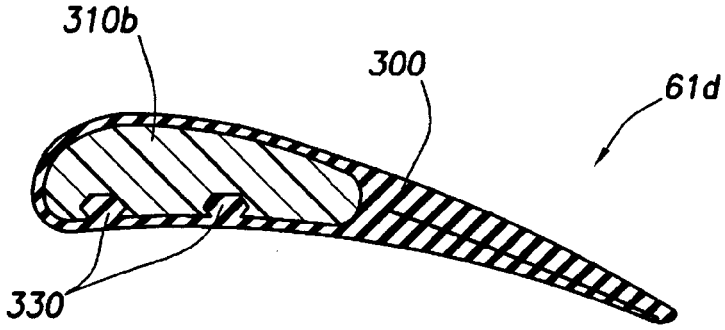
FIG. 3D is another embodiment of the blade depicted in FIG. 3A having a modified core.

FIG. 3D depicts another variation of the blade 61*d*. In this embodiment, the core 310*b* is provided with two cavities 330. The body portion 300 surrounds the core and fills the cavities. One or more such cavities of various shapes may be provided in the core to alter the balance, structure, weight, and other characteristics of the core and/or the blade.

Figure 3E:
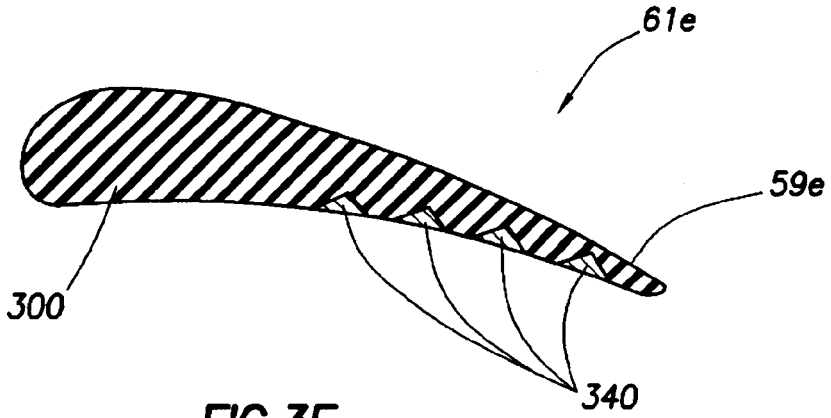
FIG. 3E is another embodiment of the blade depicted in FIG. 3A utilizing a shape memory alloy.

FIG. 3E depicts another optional configuration for the blade 61*e* utilizing shape memory alloy (SMA). An SMA, such as Nitinol (Nickel-Titanium Alloy), has a stress phase transformation when stressed. During the transformation, the stress-strain curve is horizontal from about 1% to about 10% strain, depending on exact temperature and alloy composition. This leads to hyper-elastic properties of the material. An SMA may be incorporated into various portions of the blade to increase or decrease the deformability of various portions of the blade. The horizontal portion of an SMA stress-strain curve implies that when the flow reaches a certain velocity, stress will reach the point of instability. Once instability is reached, the blade will bend within a predictable range thereby providing controlled deformation of the blade.

As shown in FIG. 3E, portions of the blade, such as notches 340, are made of SMA. The notches 340 are preferably positioned in the trailing portion 59*e* of the blade 61*e* to permit the trailing portion of the blade to deform more easily. Various numbers of notches or various dimensions may be positioned about the blade to place portions of the blade under varying stresses.

Figure 3F:
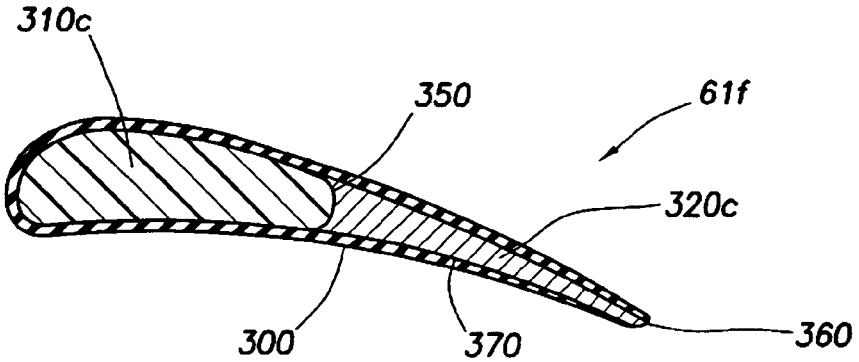
FIG. 3F is another embodiment of the blade depicted in FIG. 3A having a core, spline and metal liner.

FIG. 3F depicts another optional configuration for the blade 61*f*. The blade 61*f* is the same as the blade in FIG. 3A, but includes a core 310*c* and a spline 320*c*. The spline 320*c* is preferably made of SMA, and has a leading end 350 and a tailing end 360. The spline 320*c* is wider at the leading end 350 and terminates at the trailing end 360. The spline 320*c* is coated with a layer 370 of preferably thin, flexible, low shear modulus material, such as certain rubbers, e.g. HNBR, FEPM, FKM or FFKM, to prevent the spline 320*c* from separating while keeping rigidity low. In this configuration, the flexible metal of the spline provides a moment of inertia sufficient to permit the blade to deform. Optionally, the layer 370 could be replaced by one or more structure spring elements (not shown).

While the blades in FIGS. 3A–3F are depicted as being a turbine blade made of deformable material, other components in the downhole tool may also be deformable. For example, the rotor 60 and/or the stator 52 of FIG. 2 may also be made of deformable material capable of deforming to allow fluid to flow through the modulator as desired. The rotor may be provided with deformable blades as previously described with respect to the turbine blades. Portions of the stator, such as those corresponding to the rotor and providing channels for the flow of fluid therethrough, may also be deformable. Other components, blades and/or rotatable elements affecting the torque within the downhole tool may also be made deformable.

In operation, the deformable component preferably retains its primary shape at the minimum flow rate of the tool operational flow range. It is therefore preferable that the blade be stiffest at start up and/or at low flow rates. As the flow rate and torque increase, the component may gradually deform, or change shape, in response to the flow of fluid. By deforming, the components may be used to decrease the efficiency and keep the rotating speed within a desired range. This decrease in efficiency may also be used to prevent rotational speeds in the downhole tool from increasing and/or to prevent overloading the hardware and electrical generating circuitry. The deformation also provides additional clearances for the passage of fluids and larger particles. A reduction in flow gradually returns the blades to their original configuration.

Figure 4:
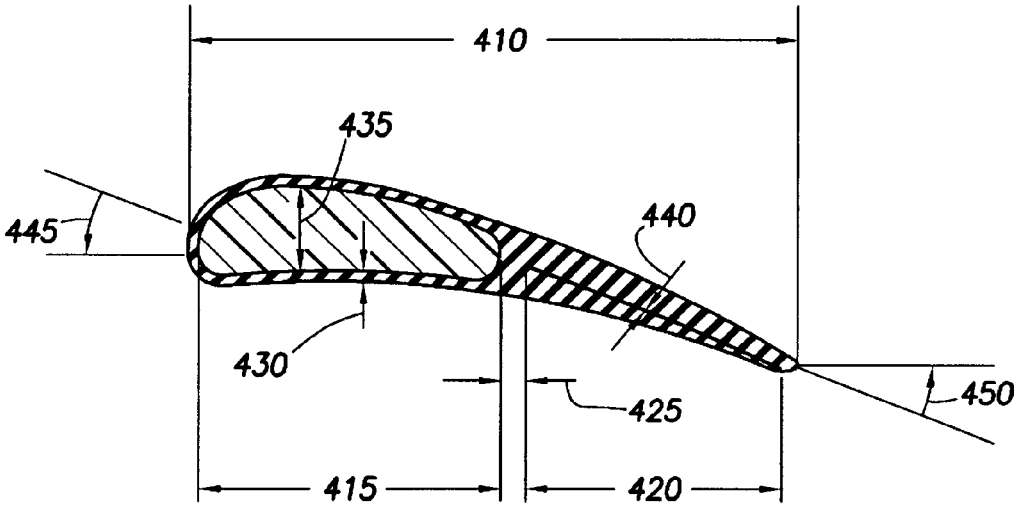
FIG. 4 is the cross sectional view of the blade of FIG. 3B depicting measurement parameters.
Figure 5:
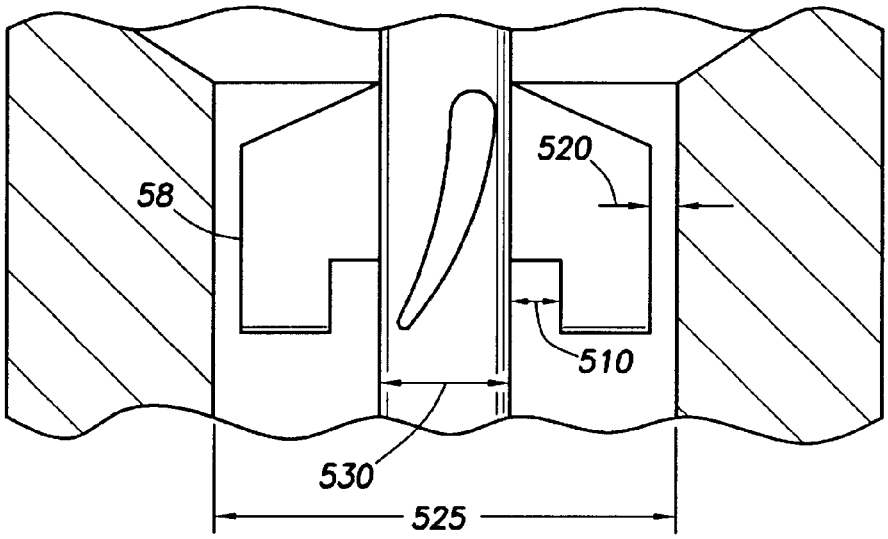
FIG. 5 is a portion of the schematic view of FIG. 2 depicting measurement parameters.

The blade has various parameters defining its structural characteristics. Some of these parameters are depicted on FIG. 4, such as the axial blade length 410, the core axial length 415, the spline axial length 420, core to spline axial distance 425, the membrane thickness at the core 430, the core thickness 435, the spline thickness 440, blade leading-edge angle 445 ($\beta_{LE}$), and blade trailing-edge angle 450 ($\beta_{TE}$). The rotor hub diameter 530 ($D_{HUB}$) and rotor tip diameter 525 ($D_{\eta\rho}$), hub clearance 510 and tip clearance 520 are depicted in FIG. 5. Other parameters of the downhole tool may also be defined, such as the material used, the blade thickness and the number of blades. The blade angles are defined with respect to the axial direction. Additionally, various operational parameters may also be adjusted, such as the volumetric flow range ([$Q_{min}$, $Q_{max}$]), shaft speed ($\omega$), fluid density ($\rho$), and fluid viscosity ($\mu$).

Traditionally, turbine blades are designed using a one-dimensional approach, providing the rotor ideal torque. This analysis leads to the expression of the rotor ideal torque according to the following equation:

$$T_{ideal}(\omega,Q)=\rho Q^2(\tan(\beta_{TE})-\tan(\beta_{LE}))A-\rho Q\omega B \quad (1)$$

where A and B are constants depending on the hub and tip diameters. Introducing the rotor hydraulic efficiency $\eta(\omega,Q)$, the rotor torque can be related to $T_{IDEAL}(\omega,Q)$ as follows $$T(\omega,Q)=\eta(\omega,Q)T_{IDEAL}(\omega,Q) \quad (2)$$

Equation (2) may be used as a starting point in an iterative, experimental design approach for determining the characteristics of deformable blades. For examples, a design of experiments may be used to evaluate different types of materials (ie. rubber), different dimensions, different support members, different cores, etc.

Alternatively, advanced numerical methods may be used to determine the desired blade structural properties. This so-called fluid structure interaction (FSI) approach may be used to determine the rubber material constants for given torque specifications. FSI is a numerical approach which solves in a coupled manner the interaction between a solid deformable body and fluid flow. The rubber hyper-elastic response can be modeled based on the Mooney equation, providing the rubber strain energy density function (W) as follows:

$$W=C_1(\lambda_2^1+\lambda_q^2+\lambda_E^2-3)+C_2(\lambda_2^{-2}+\lambda_q^{-2}+\lambda_2^{-2}-3) \quad (3)$$

In equation (3), $\lambda_2,\lambda_q,\lambda_E$ are the extension ratios in the principal directions, and $C_1$ and $C_2$ are the material constants. For a given torque specification and blade leading edge angle ($\beta_{LE}$), the values of the blade trailing edge angle at the minimum flow rate ($\beta_{TE}(Q_{min})$) and maximum flow rate ($\beta_{TE}(Q_{max})$) can be determined according to Eq. (1). The parameters blade angles ($\beta_{LE}$ and $\beta_{TE}$) are depicted in FIG. 4.

The FSI computational approach generates values of $C_1$ and $C_2$ that would lead to approximations of the trailing edge angles ($\beta_{TE}(Q_{min})$ and $\beta_{TE}(Q_{max})$) at a given shaft speed. The FSI approach also provides the variation of turbine torque as a function of the flow rate. The FSI computational approach allows for changes in structural and/or operational properties of the downhole system, such as changes in velocity, changes in flow range, changes in fluid properties, changes in turbine geometry (number of blades, diameters, leading and trailing edge angles), and changes in shaft speed.

While the invention has been described with respect to a limited number of embodiments, those skilled in the art, having benefit of this disclosure, will appreciate that other embodiments can be devised which do not depart from the scope of the invention as disclosed herein. For example, the elastomeric members may be used in any downhole operation involving rotatable elements. Accordingly, the scope of the invention should be limited only by the attached claims.

What is claimed is:

1. A pressure pulse generator for a downhole drilling tool, the drilling tool having a channel therein adapted to pass drilling mud therethrough, comprising:

a rotor rotationally mounted to a drive shaft in the generator; and a stator positioned in the pulse generator such that rotation of the rotor relative to the stator creates pressure pulses in the drilling mud;

wherein at least one of the rotor, the stator and combinations thereof is selectively deformable in response to the flow of drilling mud through the generator whereby the torque is controlled.

2. The pressure pulse generator of claim 1 further comprising a turbine impeller mechanically coupled to the drive shaft, the turbine impeller having at least one turbine blade operatively connected thereto.

3. The pressure pulse generator of claim 2 wherein at least one of the rotor, the stator, and the turbine blade and combinations thereof is selectively deformable in response to the flow of drilling mud through the generator whereby the torque is controlled.

4. The pressure pulse generator of claim 3 wherein the at least one of the rotor, the stator, and the turbine blade and combinations thereof comprises a deformable material.

5. The pressure pulse generator of claim 4 wherein at least a portion of the deformable material comprises an elastomeric material.

6. The pressure pulse generator of claim 4 wherein at least a portion of the deformable material comprises an SMA.

7. The pressure pulse generator of claim 6 wherein the at least a portion is a notch.

8. The pressure pulse generator of claim 4 wherein the at least one of the rotor, the stator, and the turbine blade and combinations thereof further comprises a core.

9. The pressure pulse generator of claim 8 wherein the core is a non-deformable material.

10. The pressure pulse generator of claim 8 wherein the core has at least one cavity therein.

11. The pressure pulse generator of claim 8 wherein the at least one of the rotor, the stator, and the turbine blade and combinations thereof further comprises a spline.

12. The pressure pulse generator of claim 11 wherein the spline is made of a non-deformable material.

13. The pressure pulse generator of claim 12 further comprising a metal layer about the spline.

14. The pressure pulse generator of claim 2 wherein at least one of the rotor, the stator, the turbine and combinations thereof rotates.

15. A method of controlling fluidic torque a fluid passing through a downhole drilling tool, the method comprising:

providing the downhole drilling tool with a generator having a rotor and a stator;

positioning the downhole drilling tool into a wellbore;

passing fluid through the generator at an initial flow rate; and increasing the flow rate of the fluid passing through the generator such that one of the rotor, the stator and combinations thereof are deformed from an original position to a deformed position.

16. The method of claim 15 further comprising decreasing the flow rate of the fluid passing through the generator and returning the one of the rotor, the stator and combinations thereof to the original position.

17. The method of claim 15 wherein the generator further comprises a turbine having a turbine blade operatively connected thereto, and wherein the step of increasing comprises increasing the flow rate of the fluid passing through the generator such that one of the rotor, the stator, the turbine and combinations thereof are deformed from an original position to a deformed position.

18. The method of claim 17 wherein the one of the rotor, the stator, the turbine and combinations thereof comprises a deformable material adapted to selectively deform in response to the flow of fluid through the downhole drilling tool.

19. The method of claim 18 wherein the deformable material has a core therein.

20. The method of claim 19 wherein the deformable material has a spline therein.

21. The method of claim 18 wherein the deformable material comprises an elastomeric material.

22. The method of claim 18 wherein the deformable material comprises a SMA.

23. The method of claim 17 further comprising determining the parameters of the one of the rotor, the stator and the turbine to generate the desired torque.

24. The method of claim 23 wherein the parameters are determined by experimental methods.

25. The method of claim 23 wherein the parameters are determined by numerical methods.

26. The method of claim 23 adapting the one of the rotor, the stator, the turbine and combinations thereof to the determined parameters.

27. The method of claim 15 further comprising optimizing the torque generated by the flow of fluid through the drilling tool by adjusting the parameters of the one of the rotor, the stator and combinations thereof to selectively deform in response to the flow rate.

28. A downhole drilling tool having a channel therein adapted to pass drilling mud therethrough, the tool comprising:

at least one blade operatively connected to the downhole tool, the at least one blade rotatable in response to the flow of fluid through the drilling tool, the at least one blade adapted to selectively deform in response to the flow of drilling mud through the channel.

29. The drilling tool of claim 28 wherein the blade comprises an elastomeric material.

30. The drilling tool of claim 28 wherein the blade comprises a SMA.

31. The drilling tool of claim 29 wherein the blade further comprises a core.

32. The drilling tool of claim 31 wherein the core has a cavity therein.

33. The drilling tool of claim 30 wherein the blade further comprises a spline.

34. The drilling tool of claim 29 wherein the blade further comprises a notch.

35. The drilling tool of claim 28 wherein the blade is part of a turbine.

36. The drilling tool of claim 28 wherein the blade is operatively connected to a generator.

37. A method of controlling fluidic torque a fluid passing through a downhole drilling tool, the method comprising:

providing the downhole drilling tool with a rotatable element comprising a deformable material;

positioning the downhole drilling tool into a wellbore;

passing fluid through the generator at an initial flow rate; and increasing the flow rate of the fluid passing through the generator such that one of the rotor, the stator and combinations thereof are deformed from an original position to a deformed position.

38. The method of claim 37 wherein the rotatable element is one of a rotor, a stator, a turbine and combinations thereof.

39. The method of claim 38 wherein the deformable material comprises one of rubber, SMA and combinations thereof.

* * * * *